US006648358B2

(12) United States Patent
Catanescu et al.

(10) Patent No.: US 6,648,358 B2
(45) Date of Patent: Nov. 18, 2003

(54) METHOD AND APPARATUS FOR COUPLING A WHEELCHAIR TO AN EXERCISE DEVICE

(76) Inventors: Florea Catanescu, 8236 Holly Oaks St., Citrus Heights, CA (US) 95610; Codruta Diana Catanescu, 8236 Holly Oaks St., Citrus Heights, CA (US) 95610; Florela Liana Catanescu, 8236 Holly Oaks St., Citrus Heights, CA (US) 95610

( * ) Notice: Subject to any disclaimer, the term of this patent is extended or adjusted under 35 U.S.C. 154(b) by 96 days.

(21) Appl. No.: 10/082,381

(22) Filed: Feb. 25, 2002

(65) Prior Publication Data

US 2003/0160424 A1 Aug. 28, 2003

(51) Int. Cl.[7] ..... A63B 21/008
(52) U.S. Cl. ..... 280/304.1; 482/904
(58) Field of Search ..... 280/250.1, 304.1; 482/112, 121, 128, 129, 904; 403/161–163, 83–85, 89

(56) References Cited

U.S. PATENT DOCUMENTS 5,643,143 A * 7/1997 Burak et al. ..... 482/54
5,709,631 A * 1/1998 Kleinsasser ..... 482/51
5,839,995 A * 11/1998 Chen ..... 482/92
6,142,914 A * 11/2000 Crawford et al. ..... 482/51
6,334,624 B1 * 1/2002 Giglio ..... 280/304.1

* cited by examiner

*Primary Examiner*—Lesley D. Morris
*Assistant Examiner*—L. Lum
(74) *Attorney, Agent, or Firm*—Davis & Associates; William D. Davis

(57) ABSTRACT

A method for coupling a wheelchair to an exercise device includes the step of receiving a first wheel of the wheelchair in a first wheel stop to limit forward motion relative to the exercise device. A pin is inserted through the wheel stop and behind the inner periphery of the wheel to limit backward motion of the wheelchair. If necessary, a leg of the exercise device is longitudinally adjusted to adjust a distance between components of the exercise device and the user. A second wheel may be similarly pinned to limit both translation and rotation of the wheelchair relative to the exercise device. The user may then perform the desired exercise routines. Upon completion, the user can disengage from the exercise device by removing the pins.

25 Claims, 3 Drawing Sheets

METHOD AND APPARATUS FOR COUPLING A WHEELCHAIR TO AN EXERCISE DEVICE

FIELD OF THE INVENTION

The invention relates to methods and apparatus for coupling a wheelchair to an exercise device thereby providing persons in wheelchairs with the opportunity to utilize exercise equipment.

BACKGROUND OF THE INVENTION

Various types of devices tailored to the physical health and exercise areas exist on the consumer market. Examples of these include stationary bicycles, weight lifting devices, and rowing machines. These devices or machines are typically designed for and used by individuals who are not mobility impaired.

Individuals with a severe injury or disability will likely have difficulty utilizing such an exercise device properly, especially if they are confined to a wheelchair. Elderly or handicapped persons confined to wheelchairs are at an extreme disadvantage in the areas of mobility, maneuverability, and sometimes dexterity. Attempted use of exercise devices by persons in wheelchairs can be problematic, if not dangerous, due to instability and movement of the wheelchair relative to the exercise device. Although wheelchairs typically have wheel brake systems, these wheel brakes systems are not designed to handle a significant load. Moreover, the brakes ultimately rely on frictional forces between the wheels and the floor. Thus the brakes are incapable of eliminating movement of the wheelchair relative to the exercise device.

SUMMARY OF THE INVENTION

In view of limitations of known systems and methods, methods and apparatus for coupling a wheelchair to an exercise device are described.

In one embodiment, the coupling apparatus includes a pin and at least one wheel stop for receiving a wheelchair wheel. The wheel stop is attached to the exercise device. The pin is then inserted into a hole pair on the wheel stop and behind the inner periphery of the wheelchair wheel. Once the pin is inserted, forward and backward movement relative to the exercise device are limited. This stabilization provides the user with the opportunity to safely utilize the exercise device while in the wheelchair. To add further stability, a second wheel stop and pin may be used to eliminate rotation of the wheelchair relative to the exercise device. A receiving portion of the wheel stop may have a shape complementary to that of the wheel chair wheel to achieve a good fit.

Upon completion of the desired exercise activity, the user may disengage the wheelchair from the exercise apparatus by removing the pins. In various embodiments, the pins may have features to enable easier handling such as a ring at one end. The pins may also include locking features to prevent the pin from falling out unintentionally during exercise.

DESCRIPTION OF THE DRAWINGS

The present invention is illustrated by way of example and not limitation in the figures of the accompanying drawings, in which like references indicate similar elements and in which.

DETAILED DESCRIPTION

Figure 1:
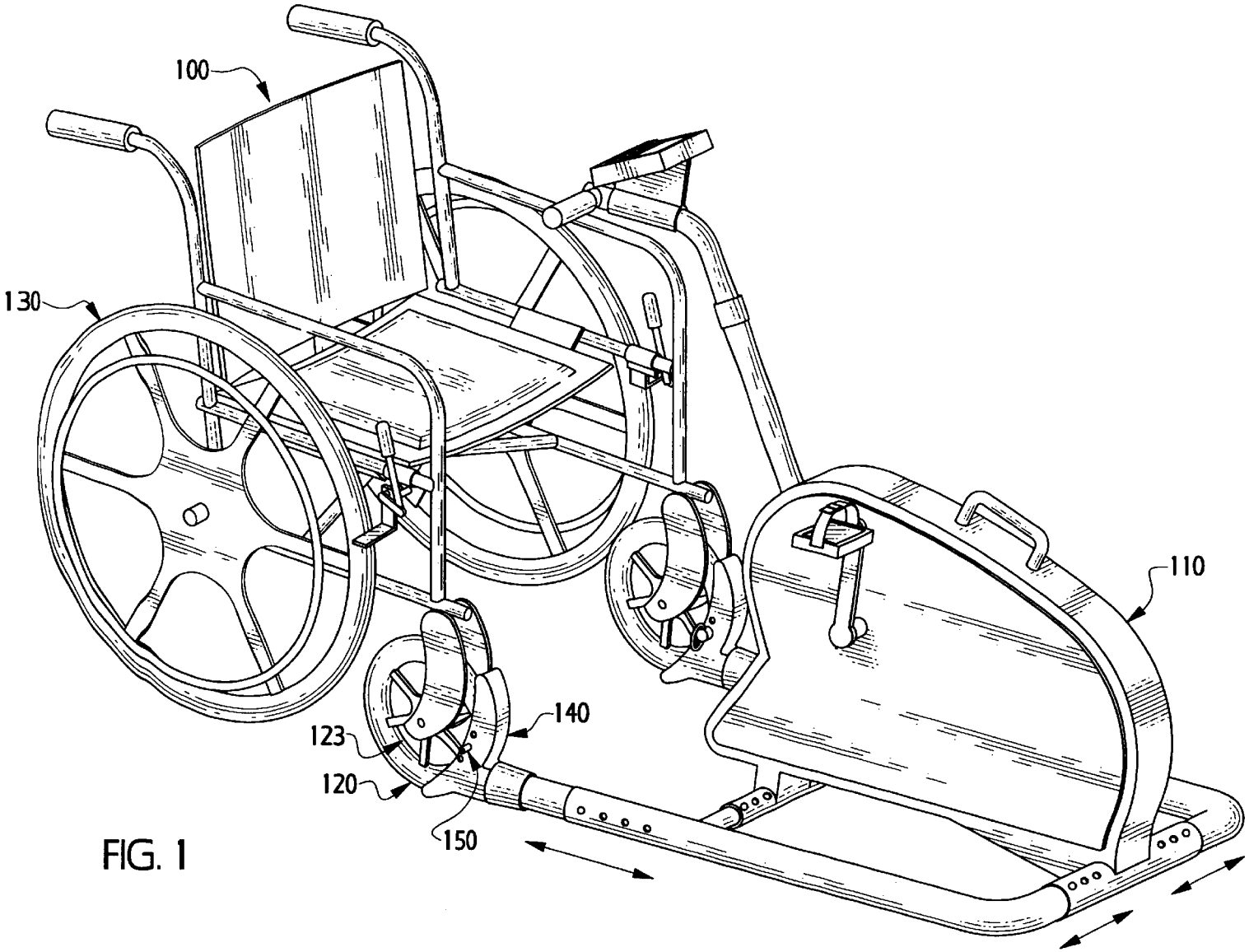
FIG. 1 displays one embodiment of an apparatus for coupling a wheelchair to an exercise device.

An example of the present invention showing a wheelchair 100 coupled to an exercise device 110 can be seen in FIG. 1. The wheelchair is a readily available type having at least two anterior wheels 120 and two posterior wheels 130. The exercise device is outfitted with wheel stops 140 designed to engage the wheels of the wheelchair. In the illustrated embodiment, a pin 150 is inserted through the wheel stop and behind an inner periphery 123 of the anterior wheel to capture the wheel. In an alternative embodiment, the wheelchair may be coupled to the exercise device using the posterior wheels.

Figure 2:
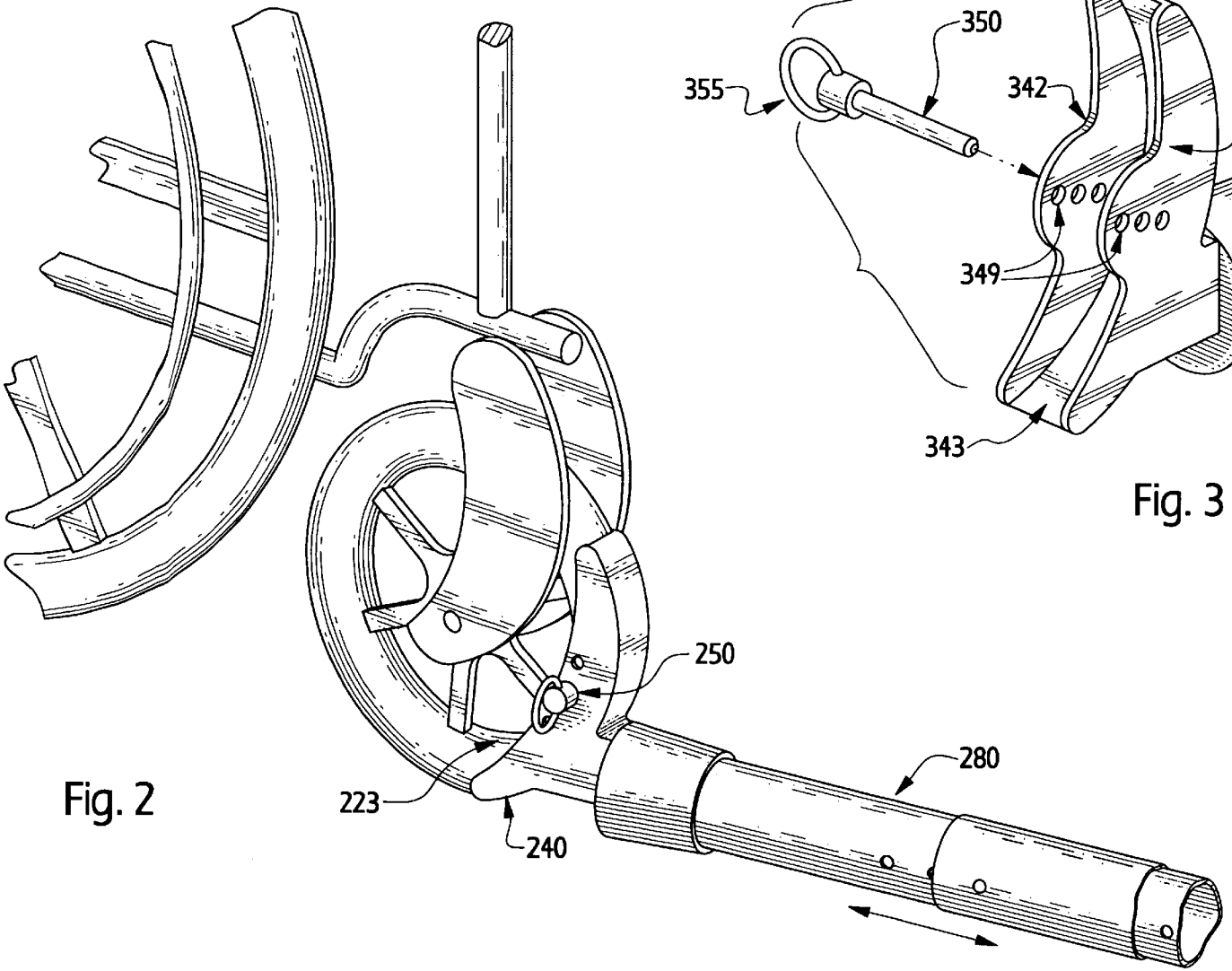
FIG. 2 shows an anterior wheelchair wheel coupled to a wheel stop with a pin inserted through the assembly.

A detailed view of the coupling apparatus is illustrated in FIG. 2. In the engaged position, the pin 250 is inserted through a first side of the wheel stop 240, behind the inner periphery 223 of the wheel, and through a second side of the wheel stop. In one embodiment, the wheel stop is attached to an extendable leg 280 used to adjust the distance between the user and the exercise device.

Figure 3:
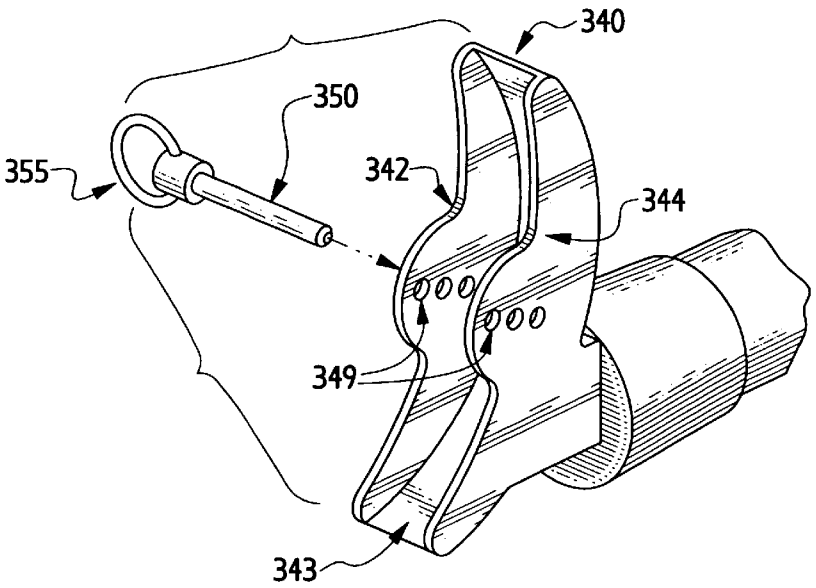
FIG. 3 provides an isometric view of the coupling apparatus including the wheel stop and the pin.

FIG. 3 provides an exploded view of the wheel stop 340 and the pin 350. The shape of the receiving portion 343 of the wheel stop is complementary to the shape of the bearing surface of the wheel 120. The wheel stop has a first side 342 and a second side 344. The first side of the wheel stop includes at least one hole for receiving a pin. In one embodiment, there is an opposing second hole in the second side, such that the first and second holes form a pair for receiving the pin. In one embodiment, the wheel stop includes a plurality of hole pairs 349 to permit accommodating wheelchair wheels of different sizes.

The proposed method for coupling the wheelchair to the exercise device and utilizing the exercise apparatus begins with the wheelchair user or assistant moving the wheelchair towards the exercise device. Once near the device, the operator must adjust the separation distance between the wheel stops to match the distance between the anterior wheels of the wheelchair. This alignment enables the anterior wheels to properly engage the wheel stops. The wheelchair is then moved toward the exercise device until the anterior wheels are received by the wheel stops.

A first pin is then inserted into a selected hole pair of one wheel stop, such that the pin is behind an inner periphery of the respective wheel. The wheel stop limits forward motion of the wheelchair relative to the exercise device. The pin limits backward motion of the wheelchair relative to the exercise device. For additional stability, a second pin may be similarly used with the other wheel stop to limit rotation of the wheelchair relative to the exercise device. The pins and the wheel stops co-operate to limit forward and backward movement of the wheelchair relative to the device.

Once the wheelchair user has completed the exercise program, the user or assistant will be able to disengage the wheelchair from the exercise device by removing the first and second pins from their respective wheel stops. In one embodiment, each pin comprises a ring 355 to permit easy handling of the pin. In various embodiments, the pin may further comprise a locking feature such as a ball detent to prevent unintentional disengagement of the wheelchair from the wheel stops.

Figure 4:
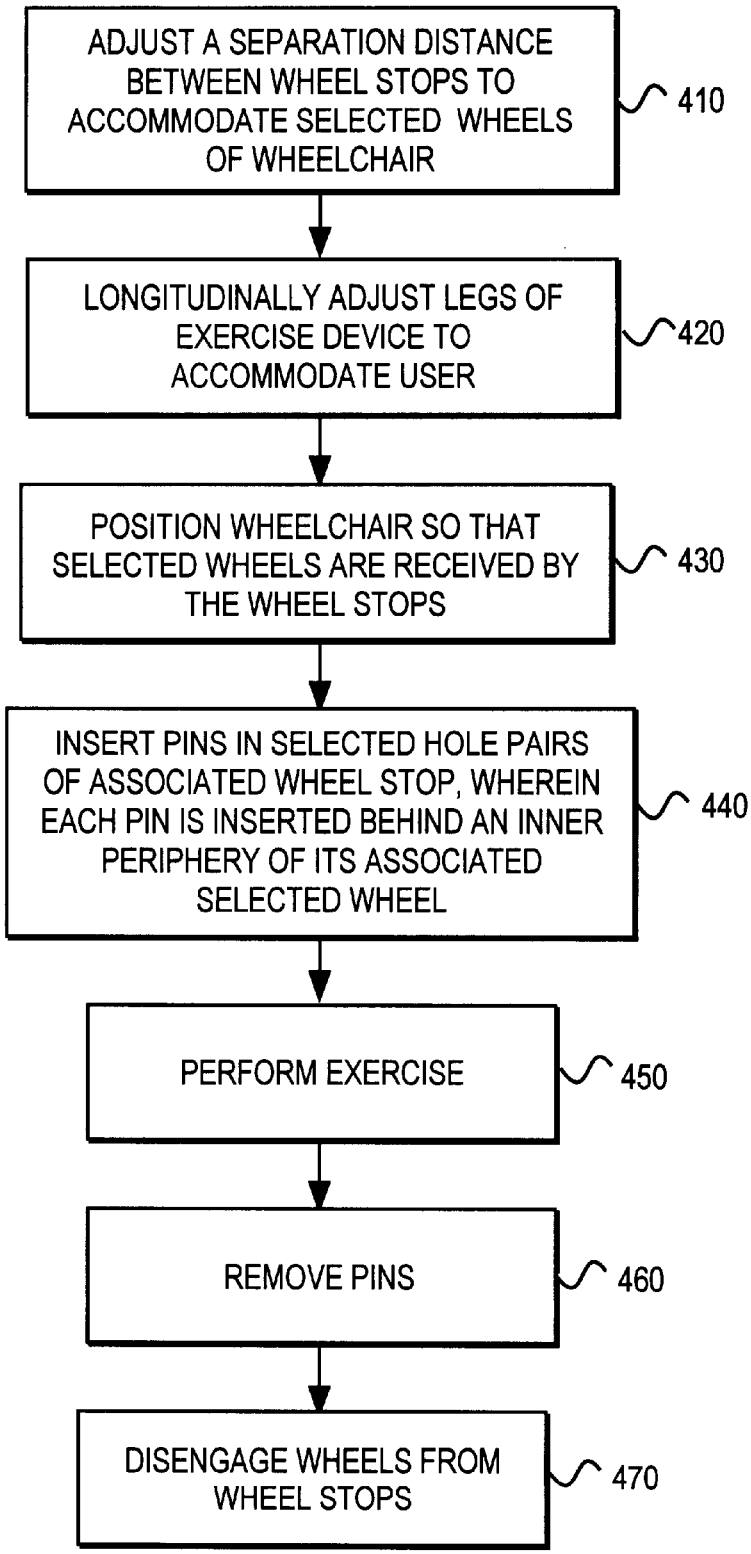
FIG. 4 illustrates one embodiment of a method of using the coupling apparatus.

FIG. 4 summarizes the method of coupling the wheelchair to an exercise device. In step 410, the separation distance between the wheel stops is adjusted, if necessary, to accommodate a distance between the wheelchair wheels to be captured (e.g., anterior or posterior wheels).

In some embodiments, the wheel stops may be attached to longitudinally adjustable legs in order to permit adjusting the distance between various components of the exercise device and the user. If so, then the legs are longitudinally adjusted to the user's preference in step 420.

In step 430, the wheelchair is positioned such that the selected wheels are received by the wheel stops. In step 440, the pins are placed in selected hole pairs of their associated wheel stops.

The user may then perform the desired exercise in step 450. The pins and wheel stops cooperate to limit translational motion of the wheelchair relative to the exercise device. When the user has finished exercising, the pins are removed in step 460. The wheelchair wheels may be disengaged from the exercise device in step 470.

What is claimed is:

1. A method of coupling a wheelchair to an exercise device, comprising the steps of:

a) positioning a first wheel of the wheelchair against a first wheel stop of the exercise device to limit forward movement of the wheelchair, and b) inserting a first pin through the wheel stop and behind an inner periphery of the first wheel to limit backward movement of the wheelchair, wherein the first wheel stop and the first pin co-operate to limit movement of the wheelchair relative to the exercise device.

2. The method of claim 1 further comprising the steps of:

c) positioning a second wheel of the wheelchair against a second wheel stop; and d) inserting a second pin through a second wheel stop and behind an inner periphery of the second wheel.

3. The method of claim 1 further comprising the step of:

c) adjusting a distance between the first and second wheel stops.

4. The method of claim 1 further comprising the step of:

c) longitudinally adjusting a length of an extendable leg coupling the wheel stop to the exercise device.

5. The method of claim 1 wherein step b) further comprises the step of locking the first pin in place.

6. The method of claim 1 further comprising the step of:

c) locking at least one wheelchair wheel.

7. The method of claim 1 further comprising the step of c) removing the first pin to disengage the wheelchair from the exercise device.

8. The method of claim 1 wherein the wheelchair comprises a set of anterior wheels and a set of posterior wheels wherein the first wheel is an anterior wheel.

9. The method of claim 1 wherein the first wheel stop includes a plurality of hole pairs for receiving the first pin, wherein the method further comprises the step of:

c) selecting one pair of the plurality of hole pairs for receiving the first pin.

10. An apparatus for coupling a wheelchair to an exercise device, comprising:

a wheel stop for receiving a wheel of the wheelchair, the wheel stop coupled to the exercise device; and a pin, inserted through the wheel stop and behind an inner periphery of the wheel, wherein the wheel stop and the pin co-operate to limit forward and backward translation of the wheelchair relative to the exercise device.

11. The apparatus in claim 10 wherein the exercise device further comprises an extendable leg, wherein the wheel stop is coupled to the extendable leg.

12. The apparatus in claim 10 wherein the pin further comprises a locking feature.

13. The apparatus in claim 10 wherein the wheel stop has a plurality of paired hole locations for receiving the pin to accommodate different sizes of wheelchair wheels.

14. The apparatus of claim 10 wherein the wheel stop has a receiving portion, wherein a shape of the receiving portion is complementary to a shape of a bearing surface of the wheel.

15. The apparatus of claim 10 wherein the pin further comprises a pulling aid.

16. The apparatus of claim 15 wherein the pulling aid comprises a ring.

17. An apparatus for coupling a wheelchair to a device, comprising:

a plurality of wheel stops coupled to the device, wherein at least one wheel stop is positioned to receive a wheel of the wheelchair; and a plurality of pins, wherein at least one pin is inserted through the at least one wheel stop and behind an inner periphery of the wheel, wherein the at least one wheel stop and the at least one pin co-operate to limit forward and backward translation of the wheelchair relative to the device.

18. The apparatus of claim 17 wherein the at least one wheel stop further comprises a plurality of pin receiving hole pairs.

19. The apparatus of claim 17 wherein the device is an exercise device.

20. The apparatus of claim 17 wherein the plurality of wheel stops receive two wheels of the wheelchair, each associated with a corresponding wheel stop.

21. The apparatus of claim 20 wherein the two wheels of the wheelchair are anterior wheelchair wheels.

22. The apparatus of claim 17 wherein a shape of a receiving portion of each of the wheel stops is complementary to a shape of a bearing surface of the received wheel.

23. The apparatus of claim 17 wherein the at least one pin further comprises a pulling aid.

24. The apparatus of claim 17 wherein the at least one pin further comprises a locking feature.

25. The apparatus of claim 17 wherein the wheel stop is coupled to a longitudinally adjustable leg of the device.

* * * * *